US006334705B1

(12) United States Patent
Weetman

(10) Patent No.: US 6,334,705 B1
(45) Date of Patent: Jan. 1, 2002

(54) FLUID MIXING IMPELLERS WITH SHEAR GENERATING VENTURI

(75) Inventor: Ronald J. Weetman, Rochester, NY (US)

(73) Assignee: General Signal Corporation, Stamford, CT (US)

( * ) Notice: Subject to any disclaimer, the term of this patent is extended or adjusted under 35 U.S.C. 154(b) by 0 days.

(21) Appl. No.: 09/164,918

(22) Filed: Oct. 1, 1998

(51) Int. Cl.[7] ..... B01F 7/22

(52) U.S. Cl. ..... 366/330.1; 416/228; 416/233; 416/236 R

(58) Field of Search ..... 366/102, 270, 366/330.1–330.7; 416/90 R, 91, 92, 179, 223 R, 228, 232, 233, 235, 236 R

(56) References Cited

U.S. PATENT DOCUMENTS

| | | | | | |
|---|---|---|---|---|---|
| 24,508 | A | * | 6/1859 | Vergne | |
| 262,681 | A | * | 8/1882 | Maringer | |
| 725,877 | A | * | 4/1903 | Rommeney | |
| 1,244,786 | A | * | 10/1917 | Seymour | |
| 1,461,913 | A | * | 7/1923 | Kelly | |
| 1,597,175 | A | * | 8/1926 | Boening | |
| 1,758,560 | A | * | 5/1930 | Currie | |
| 1,955,929 | A | * | 4/1934 | Mueller | |
| 2,010,094 | A | * | 8/1935 | Leinweber | |
| 2,013,473 | A | * | 9/1935 | Meyer et al. | |
| 2,014,032 | A | * | 9/1935 | Shapre et al. | |
| 2,027,050 | A | * | 1/1936 | Leinweber | |
| 2,045,918 | A | * | 6/1936 | Moody | |
| 2,238,749 | A | * | 4/1941 | Peltier | |
| 2,240,841 | A | * | 5/1941 | Flynn | |
| 2,265,788 | A | * | 12/1941 | Wolf, Sr. et al. | |
| 2,431,478 | A | * | 11/1947 | Hill | |
| 3,044,559 | A | * | 7/1962 | Chajmik | |
| 3,171,495 | A | * | 3/1965 | Puckett | |
| 4,004,786 | A | * | 1/1977 | Stephens | |
| 4,468,130 | A | | 8/1984 | Weetman | |
| 4,571,090 | A | * | 2/1986 | Weetman et al. | 366/270 |
| 4,636,143 | A | | 1/1987 | Zeides | |
| 4,662,823 | A | | 5/1987 | Cooke | |
| 4,721,394 | A | * | 1/1988 | Castro et al. | 366/330.1 |
| 4,722,608 | A | * | 2/1988 | Salzman et al. | 366/270 |
| 4,802,771 | A | | 2/1989 | Weetman | |
| 4,893,990 | A | | 1/1990 | Tomohiro et al. | |
| 4,896,971 | A | * | 1/1990 | Weetman et al. | 366/330.1 |
| 5,037,209 | A | * | 8/1991 | Wyss | 366/343 |
| 5,046,245 | A | | 9/1991 | Weetman et al. | |
| 5,156,778 | A | * | 10/1992 | Small | 366/102 |

(List continued on next page.)

*Primary Examiner*—Charles E. Cooley
(74) *Attorney, Agent, or Firm*—Pepper Hamilton, LLP

(57) ABSTRACT

An axial flow mixer impeller which is high in efficiency in terms of flow is made more effective, when used in a sparging system for dispersion and for mass transfer of a liquid phase or a gaseous phase into a liquid which is being mixed or agitated, by forming a shear field which breaks the phase being dispersed into fine bubbles which are dispersed by the impeller. This is accomplished without a major effect on the high flow efficiency of the axial flow impeller. To this end a structure which forms a Venturi is located on the side or sides of the blade where the phase (bubbles of fluid of different density or viscosity which are to be mixed or dispersed by the impeller) occurs, in the high velocity region near the tip of the blade. This Venturi creates a high shear field which breaks up the bubbles and disperses them as fine bubbles as they leave the impeller. The structure may be provided by a pair of proplets in the vicinity of the tip end of the blade which form a wedge shaped flow path therebetween. The structure may also be provided by an overlying blade or blade segment which has a blade angle different from the angle of the main blade so as also to provide a wedge shaped flow path which creates the shear field which shears the phase being dispersed into fine bubbles. These fine bubbles facilitate mass transfer, for example for aeration, when the gas contains oxygen.

22 Claims, 5 Drawing Sheets

U.S. PATENT DOCUMENTS 5,158,434 A * 10/1992 Weetman ..... 416/223 R
5,226,783 A 7/1993 Mita
5,277,550 A 1/1994 Kato et al.
5,297,938 A * 3/1994 Von Essen et al. ..... 416/237
5,312,567 A 5/1994 Kozma et al.
5,316,443 A * 5/1994 Smith ..... 366/270
5,326,168 A 7/1994 Miura
5,431,860 A 7/1995 Kozman et al.
5,525,269 A 6/1996 Connolly et al.
5,588,803 A 12/1996 Vetter et al.
5,595,475 A 1/1997 Weiss et al.
5,813,837 A * 9/1998 Yamamoto et al. ..... 366/330.5
5,951,162 A * 9/1999 Weetman et al. ..... 366/330.3

* cited by examiner

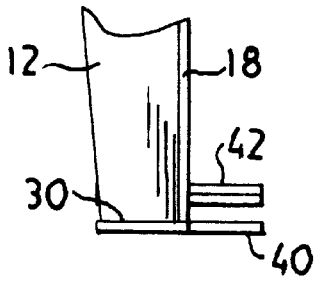
FIG. 4
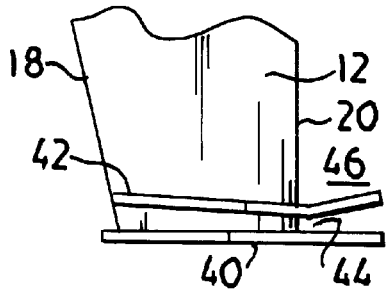
FIG. 3
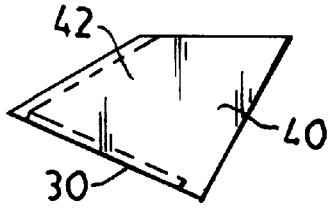
FIG. 5
FIG. 6
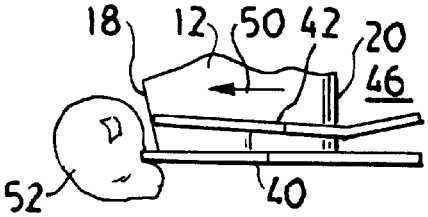
FIG. 7
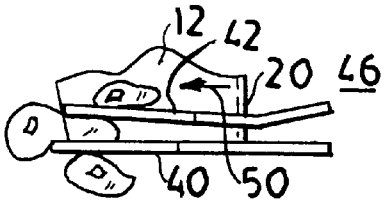
FIG. 8
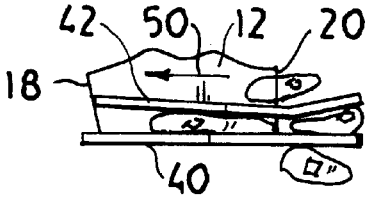
FIG. 9
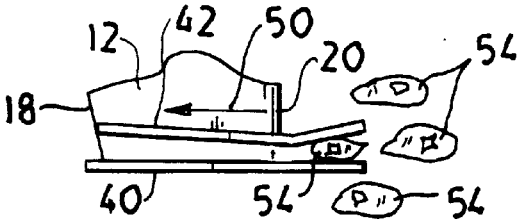

FLUID MIXING IMPELLERS WITH SHEAR GENERATING VENTURI

FIELD OF THE INVENTION

The present invention relates to mixing apparatus and particularly to a mixing impeller which produces axial flow and also is effective in dispersing one fluid (either a liquid or gas) into another fluid as the fluids are mixed by the impeller. The mixing apparatus is especially suitable for use in sparging systems for mass transfer (the transfer of the mass of one fluid phase into another) and in stirred reactors or agitators where the other fluid phase is generated during the reaction, as for example in liquid-liquid dispersion processes.

The invention provides a mixing impeller which affords efficient axial flow in the direction of the axis about which the impeller rotates, while providing a shear field which reduces the size of the media being dispersed without a significant or practical impact upon the flow efficiency of the impeller.

BACKGROUND OF THE INVENTION

Mixing impellers, which have been used for introduction of air or another fluid, operate effectively when the gas or other fluid is dispersed in the form of fine droplets. Such fine droplets make mass transfer or dissolving processes more efficient, for example, as measured by the mass transfer coefficient of the mixing system, kLa. The introduction of the gas or other fluid is called sparging. Axial flow impellers, particularly those with large blades, have been effectively used in sparging and provide high efficiency by benefiting from the efficient axial flow now produced by the impeller. One such axial flow sparging system, and mixing impellers used therein, are described in Weetman et al, U.S. Pat. No. 5,046,245 issued Sep. 10, 1991. It is desirable, therefore, to use axial flow impellers, and particularly those with even more efficient pumping as a obtained by narrow blades, such as described in Weetman U.S. Pat. No. 4,468,130 issued Aug. 28, 1984, which are even more efficient in terms of flow than the impellers described in U.S. Pat. No. 5,046,245. Nevertheless, the efficiency of sparging is adversely affected by the size of the bubbles of the phase (liquid of gas or gas) being dispersed into the flow produced by the mixing impellers. It has been proposed to provide turbulence adjacent the impeller by various elements which disrupt the flow (See for example, Cooke 4,662,823, May 5, 1987 and Kozma et al, 5,312,567, May 17, 1994 and 5,431,860, Jul. 11, 1995). However, the turbulizing elements block the flow and sacrifice the inherent efficiency of the impeller.

SUMMARY OF THE INVENTION

It is a feature of the present invention to provide a shear field which effectively breaks down the size of the bubbles or droplets of the phase to be dispersed and disperses the phase in the form of much finer bubbles or droplets than would otherwise be the case. The invention provides structure carried by the impellers which creates the shear field. Such structure is to be distinguished from expedients to reduced turbulence and discontinuities in the flow about an around an impeller or to stabilize the impeller; for example, slotted or multiple blades or fins or other projections attached to the impeller blades. See in this connection the following U.S. Pat. Nos.: Zeides, 4,636,143, Jan. 13, 1987, Tomohiro et al, 4,893,990, Jan. 16, 1990, Mita 5,226,783, Jul. 13, 1993, Kato et al, 5, 277,550, Jan. 11, 1194, Weiss et al, 5,595,475, Jan. 21, 1997, Miura, 5,326,168, Jul. 5, 1994, Connolly et al, 5,525,269, Jun. 11, 1996, and also the proplets which control reverse flow around the tips in axial flow impellers such as described in the above referenced Weetman U.S. Pat. No. 4,468,130 and see also in Weetman U.S. Pat. No. 4,802,771, Feb. 7, 1989.

Accordingly, it is the principal object of the present invention to provide improved axial flow impeller apparatus which introduces shear for breaking up bubbles of a fluid phase while preserving axial flow efficiency of the impeller.

It is a still further object of the present invention to provide improved axial flow impellers which are especially suitable for use in sparging systems.

It is a still further object of the present invention to provide an improved axial flow impeller which shears droplets or bubbles into finer droplets or bubbles and disperses them into an axial flow stream produced by the impeller.

It is a still further object of the present invention to provide improved axial flow impellers which can be used in a tank in which one or more such impellers may be mounted for rotation on a shaft and where fluid is released into the tank in the form of fine bubbles or droplets which are mixed and dispersed throughout the liquid in the tank by the impeller or impellers.

Briefly described a mixing impeller provided in accordance with the invention is effective for dispersing a first fluid, that may differ in density or viscosity from a second fluid, into the second fluid while mixing the fluids with each other. The impeller has a plurality of blades oriented with respect to an axis about which the impeller rotates to provide axial flow of the fluids. The blades each have a structure providing a Venturi which is rotatable with the blades defining flow path having a width in a direction radially of the blades which is larger nearer the leading edge of the blades than the trailing edge thereof. The flow path thus converges in a direction from the leading edge to the trailing edge and may be wedge shaped. The Venturi creates a shear field which shears the second fluid into fine bubbles or droplets and disperses it into the first fluid during the mixing of the fluids by the impeller, thereby enhancing sparging and mass transfer processes which are facilitated by the mixing impeller.

The foregoing and other objects, features and advantages of the invention, as well as presently preferred embodiments thereof will become more apparent from a reading of the following description in connection with the accompanying drawings, brief descriptions of which follow.

BRIEF DESCRIPTION OF DRAWINGS

FIG. 3 is a plan view of the tip region of a blade of the impeller showing in FIG. 1 which illustrates how the proplets form a wedge shaped flow path, open at the leading edge of the blade and forming a scoop for the medium of the tank into the flow path, the flow path also has a section which diverges and opens at the trailing edge of the blade.

FIG. 4 is a front elevation of the tip region of the blade shown in FIG. 3;

FIG. 5 is a view similar to FIG. 2 showing a side elevation of the tip region of the blade illustrated in FIGS. 3 and 4;

FIGS. 6, 7, 8 and 9 are diagrammatic views similar to FIG. 3, and showing the action of the proplets in breaking up bubbles or droplets to facilitate the dispersion of a gas or liquid into the liquid in the tank which is being mixed or agitated and pumped by the impeller;

DETAILED DESCRIPTION OF THE PREFERRED EMBODIMENTS

Figure 1:
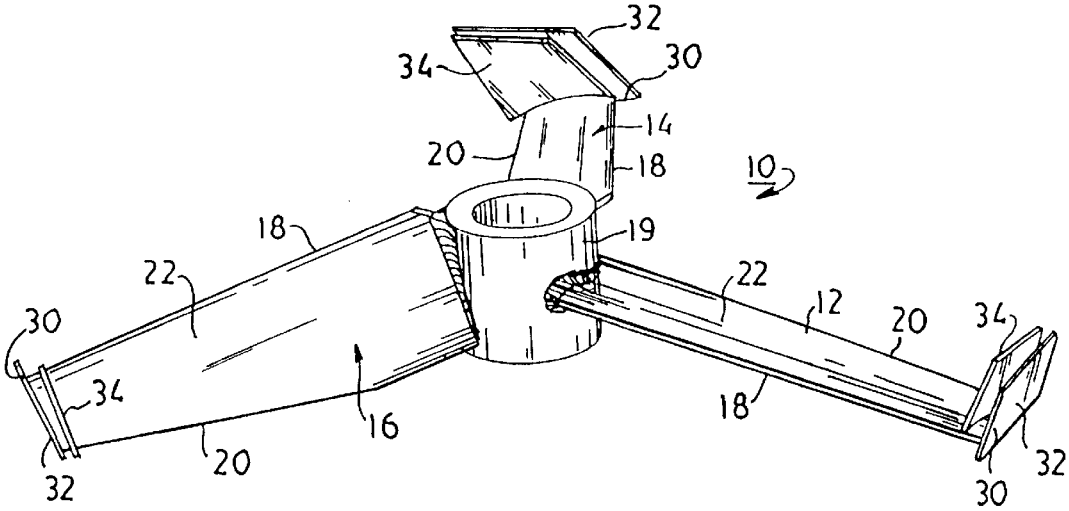
FIG. 1 is a perspective view of an axial flow mixing impeller having proplets at the end thereof which induce shear and assist in mass transfer in liquid to liquid and gas to liquid sparging systems in which the impeller may be used.
Figure 2B:
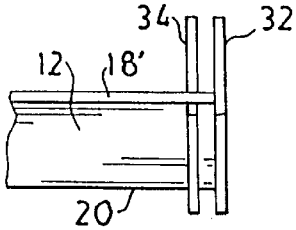
FIGS. 2A and 2B are an end and a front elevational view of one of the blades near the tip thereof showing an arrangement of the proplets which extend both above and below the upper and lower sides of the impeller, which are the convex, suction side thereof and the concave, pressure side thereof.
Figure 2:
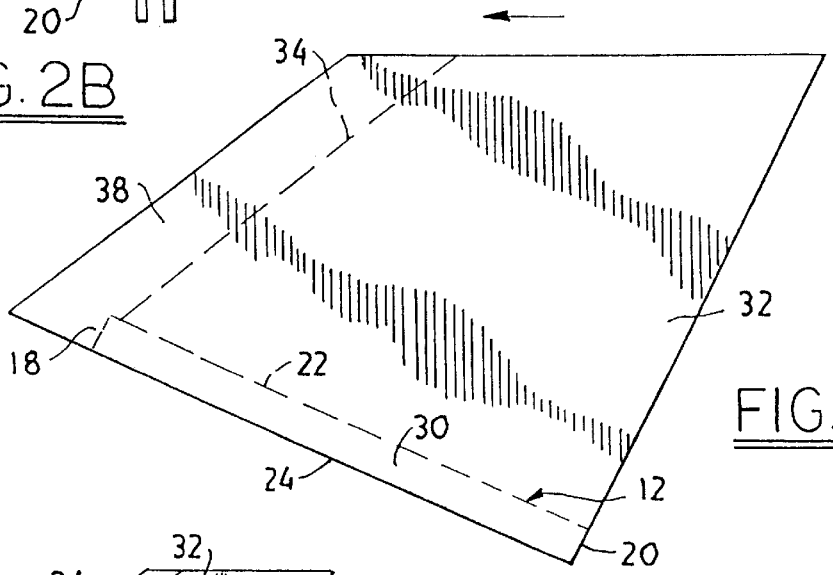
FIG. 2 is an end view of one of the impeller blades having the proplets attached thereto and showing the shape outer proplet in full lines and the tip of the blade and the shape of the inner proplet in dash lines.

Referring to FIGS. 1 and 2 there is shown a mixing impeller 10 having three blades 12, 14 and 16 which are welded to a hub 19. The hub is mounted on an impeller shaft (not shown) alone or with other impellers. The shaft may be rotated about its axis so that leading edges 18 of the blades first intercept the fluid being mixed. The fluid is pumped by the impeller in an axial direction, which is downward as viewed in FIG. 1, that is in a direction along the axis of rotation of the impeller 10. The blades have trailing edges 20 and may have camber and twist and be disposed so as to provide an angle of attack to obtain efficient axially flow from the impeller. The blade design may be in accordance with the above-referenced U.S. Weetman U.S. Pat. No. 4,468,130, but the invention may use other and different axial flow impeller designs such for example as shown in the other above-referenced Weetman and Weetman et al. Patents. The blades have tips 30 at the radially outward ends thereof.

Structures, which create shear fields in the vicinity of the tips 30 of the blades where the velocity of the blades is highest, are provided by pairs of proplets 32 and 34. The proplets 32 and 34 are tilted toward each other to define a flow path which converges in a direction toward the trailing edges of the blades. The width of the flow path, that is the separation of the proplets in the radial direction is larger at the entrance of the flow path that is near the leading edge 18 is larger than near the trailing edge. Preferably the entrance width is approximately three percent (3%) of the impeller diameter (twice the radius of the individual blades between the axis of rotation and the tip 30) and the width is approximately one percent (1%) of the impeller diameter at the exit of the flow path, which is near the trailing edge of the flow path. The width of the path is dictated by the nature (examples being density, viscosity and surface tension) of the fluid which is to be dispersed by the impeller and may be determined experimentally by selecting different flow path dimensions, that is different sizes of the wedge formed between the proplets 32 and 34 by running the system with the media, that is the liquid and fluid to be dispersed into and mixed with the liquid, for a period of a few hours and measuring the droplet or bubble size which is produced by the impeller. The wedge size, and entry and exit opening widths, providing finest droplets or bubbles is then determined to be optimum.

In the embodiment shown in FIGS. 1 and 2, the outer proplet has a front section 38 which tapers rearwardly and is spaced forwardly of the leading edge of the inner proplet 34. This structure forms a scoop which collects the medium to be dispersed, which may be moving radially of the impeller, and directs that fluid into the wedge shaped flow path.

The structure providing the wedge shaped flow path provides a Venturi which restricts the flow thereby shearing the fluid to be dispersed into fine droplets or bubbles which are released at the exit end of the Venturi and dispersed in a cloud due to the different pressure downstream of the Venturi then in the constricted part thereof.

To facilitate the manufacture of the proplet structure the outer one of the proplets may be aligned with the tip 30 while the inner proplet 34 is tilted toward the outer proplet. The proplets may be attached to the blades by welding or other suitable attachment means.

Figure 2A:
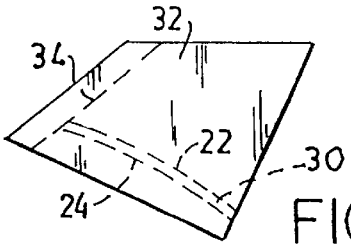

Referring to FIGS. 2A and 2B there is shown a proplet structure using two proplets 32 and 34 which form the wedge shaped flow passage as shown in FIGS. 1 and 2. The proplets extend both above the suction 22 of the blades 12 and below the pressure sides 24 thereof. The blades sides may be flat or concave and convex as shown in FIG. 2A. The proplets and the flow passageway may be on the suction side or the pressure side or both, depending upon the nature of the fluid medium being dispersed. A series of proplet panes (wedges) may also be spaces along the radius of the blades. The proplets are most advantageously disposed where the blade velocity is the greatest (at the tip). Lower density fluid, such as gases, usually collects on the suction side of the blade.

Referring to FIGS. 3, 4 and 5 there is shown an arrangement of proplets 40 and 42, the outer one of which is disposed along the tip 30 of the blade and follows the tip while the inner proplet 42 converges inwardly toward the outer proplet 40 to a neck 44 and then flares outwardly in a section of the proplet structure 46 which extends beyond the trailing edge 20 of the blade. This flared section 46 directs and aids in dispersing droplets or bubbles which are sheared in the Venturi flow passage defined by the proplets 40 and 42.

The action of the Venturi provided by the wedge shaped flow passage between the proplets 40 and 42 is shown in FIGS. 6 through 9. The arrow 50 indicates the direction of rotation of the blade 12. Large bubbles or droplets are collected at the entry end of the wedge shaped flow passage and are squeezed into elongated shape in the front of the passage. At the neck or at the exit end where there is no flared section 46, the shear field breaks the elongated bubbles into small or fine bubbles or droplets 54 which disperse at the exit of the flow passage, as illustrated by the droplet leaving the exit end in FIG. 9 and the droplets which have already left the exit end. Thus, the large droplet or bubble 52 is broken into a plurality of fine bubbles or droplets 54.

Figure 11:
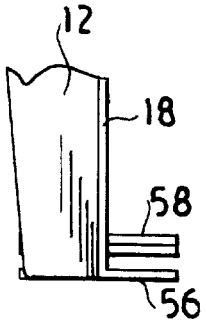
FIGS. 10, 11 and 12 are views similar to FIGS. 3, 4 and 5 showing proplets in accordance with another embodiment of the invention where the diverging section of the flow path shown in FIGS. 3–5 is not used and where the leading edges of the proplet are in alignment with the leading edge of the blade.
Figure 10:
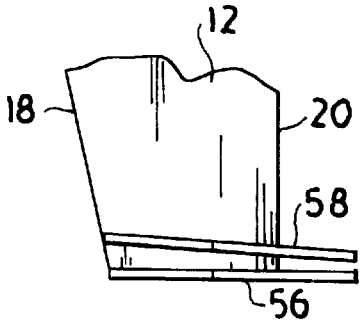
Figure 12:
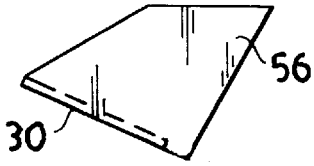

Referring to FIGS. 10, 11 and 12 there is shown a pair of proplets 56 and 58 which are similar in size and shape and which extend between the leading edge 18 and extend past the trailing edge 20 thereby providing a longer flow passage than in the other above illustrated embodiments and locating the highest shear region past the blade 12.

Figure 14:
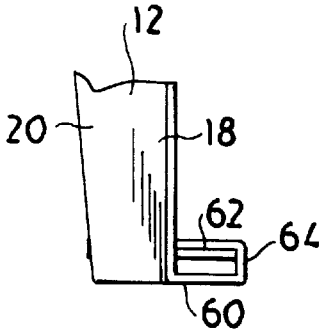
FIGS. 13, 14, and 15 are views similar to FIGS. 3, 4 and 5 showing another embodiment of the invention where the proplets are formed from a single piece of material and provide a covered section in the vicinity of the trailing edge of the blade.
Figure 13:
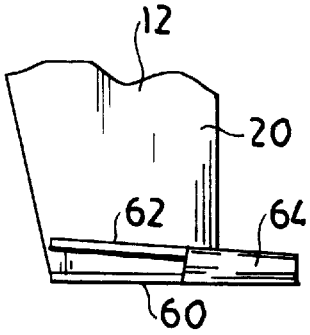
Figure 15:
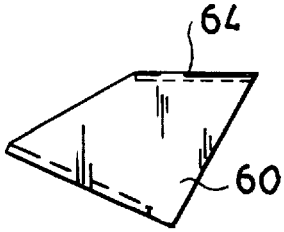

FIGS. 13, 14 and 15 illustrate a pair of proplets 60 and 62 which may be formed of three or of one piece of plate material and bent into a generally U shape having a cover 64 at the trailing end thereof. This covered trailing end may extend beyond the trailing end 20 of the blade. The cover encloses the high shear filed region of the wedge shaped Venturi.

Figure 17:
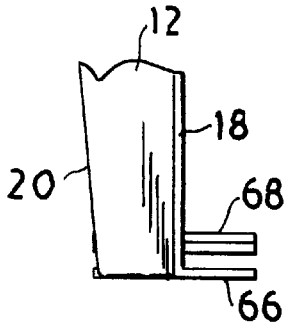
FIGS. 16, 17 and 18 are views of another embodiment of the inventions and are similar to FIGS. 3, 4 and 5, and showing the trailing edges of at least one of the proplets is serrated (scalloped) so as to provide an additional shear inducing and dispersing region.
Figure 16:
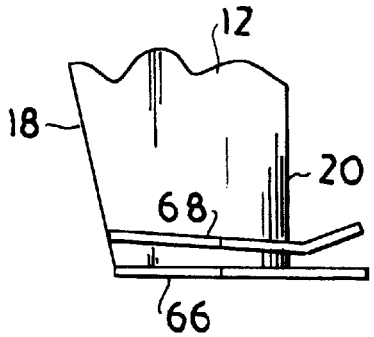
Figure 18:
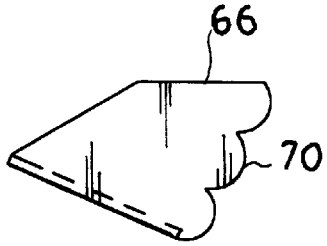

FIGS. 16, 17 and 18 show a proplet structure similar to that shown in FIGS. 3, 4 and 5. The proplets 66 and 68 are serrated along their trailing edges. The serrations provide a scalloped trailing edge 70 in the design illustrated in FIGS. 16 through 18. The serrations or scallops enhance the dispersion of the droplets as they leave the Venturi passageway.

Figure 20:
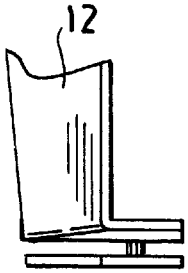
FIGS. 19, 20 and 21 are also views similar to FIGS. 3, 4 and 5 where the outer one of the proplets is disposed radially outward of the tip of the blade and is connected to the other proplet.
Figure 19:
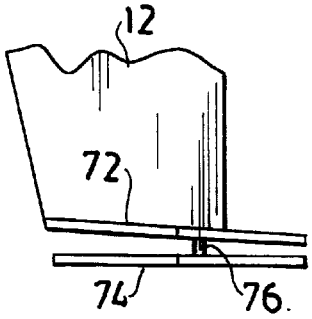
Figure 21:
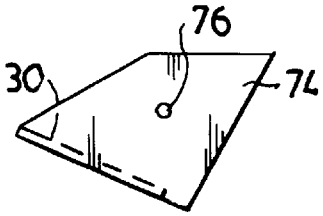

In the previously described embodiments, the proplets are inboard of the blade with the outer proplet at the tip and the inner proplet spaced radially inwardly thereof. In FIGS. 19, 20 and 21 the inner proplet 72 is disposed along the tip of the blade and forms an angle with an outer proplet 74. The proplets are held together as by a pin or pins 76. This arrangement places the shear field outwardly beyond the tip of the blades and benefits from the increased impeller velocity at this outboard location.

Figure 22:
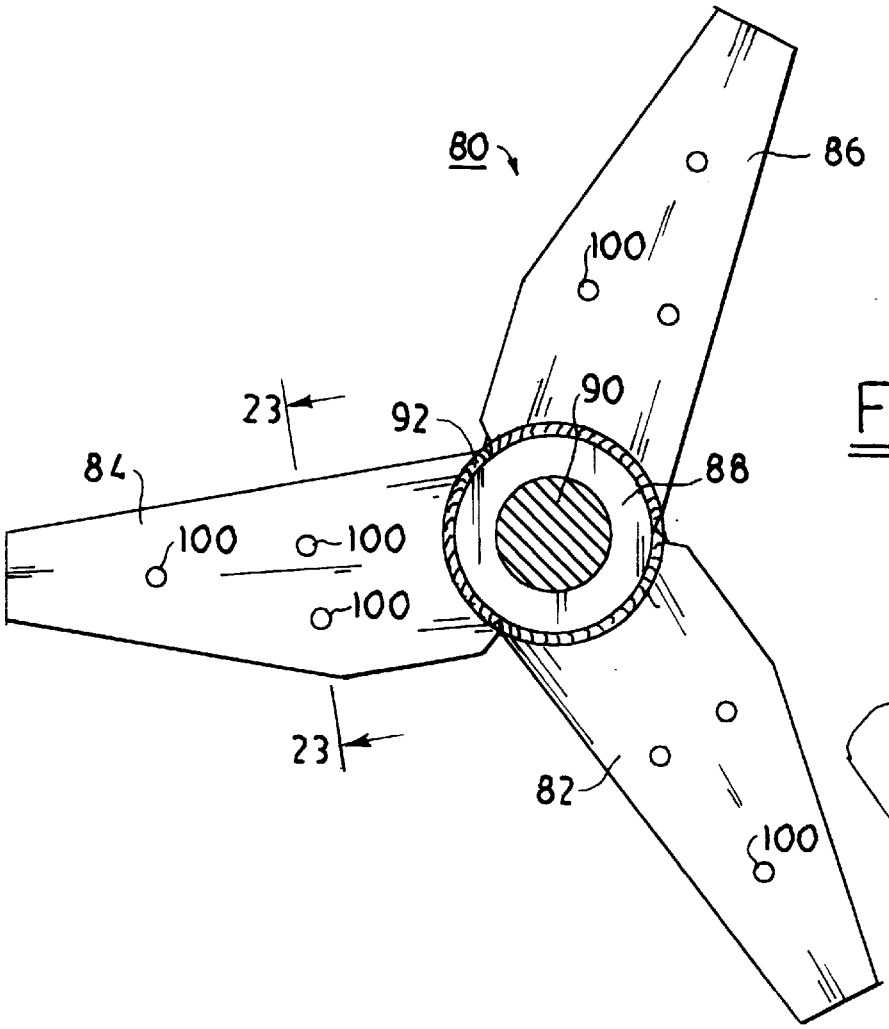
FIG. 22 is a plan view of an impeller in accordance with another embodiment of the invention having a pair of closely adjacent blades which form a wedge shape flow path, wider at the leading edge than at the trailing edge of the blades.
Figure 23:
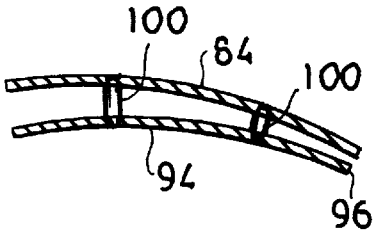
FIG. 23 is a sectional view along the line 23–23 in FIG. 22.

Referring to FIGS. 22 and 23 there is shown an impeller 80 having three blades 82, 84 and 86 on a hub 88. The hub is attached to a shaft 90, so that the impeller rotates with the shaft. The connection of the blades at the hub end thereof to the hub may be by means of a weld 92.

Figure 22A:
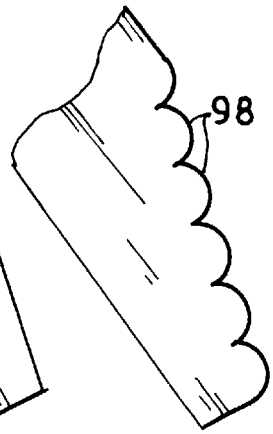
FIG. 22A shows a blade of an impeller such as shown in FIG. 22 with a serrated, and particularly a scalloped, trailing edge to enhance the dispersion of the bubbles which are sheared by the wedge shaped Venturi structures formed by the blade and by an auxiliary blade or blade segment such as shown in FIGS. 23 and 23A.

In order to create a shear field, a blade 94 is disposed below the blade 84. Alternatively, the blade 94 may be above the blade 84. The blades 84 and 94 have different blade angles; that is, the angle which the chord of the blades makes with a horizontal plane blade perpendicular to the axis of rotation of the impeller 80. The blades 84 and 94 form a generally wedge shaped passageway which provides the Venturi. The Venturi generates the shear field which breaks up bubbles and controls bubble and droplet size as was explained in connection with FIGS. 6 through 9. The blades, at least in a portion of the trailing edges 96 thereof have a serrated or scalloped edge 98, as shown in FIG. 22A, to facilitate dispersion of the bubbles or droplets as they leave the wedge shaped Venturi formed between the blades 84 and 94. The blades may be held together by pins 100 or other means for minimal obstruction with the flow path between the blades.

Figure 23A:
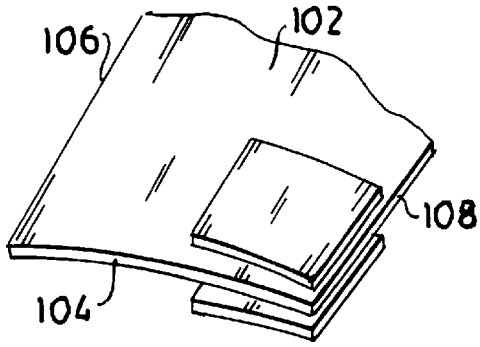
FIG. 23A is a fragmentary perspective view illustrating a pair of Venturi structures provided by blade segments near the tip and extending radially inwardly along the trailing edge of a blade of the impeller shown in FIG. 22.

Referring to FIG. 23A there is the tip end 104 shown a blade 102. This blade rotates so that one edge 106 is the leading edge of the blade, while the edge 108 is the trailing edge of the blade. Over a portion of the blade extending from the tip end 104 radially inward along the trailing edge 108 are a pair of plate segments which have curvatures similar to those of the blade 102. Each of these segments defines a separate Venturi with the upper and lower surfaces of the blade. The Venturi establishes a high shear at the trailing end thereof for bubble and droplet shearing and dispersion so as to provide a fine stream of bublets or droplets which are mixed by the impeller.

From the foregoing description it will be apparent that there has been provided improved mixing impellers especially suitable for sparging applications. Variations and modifications in the herein described mixing impellers will undoubtedly suggest themselves to those skilled in the art. Accordingly, the foregoing description should be taken as illustrative and not in a limiting sense.

What is claimed is:

1. A mixing impeller which provides for dispersion of a first fluid differing from a second fluid when said fluids are mixed by said impeller, which impeller comprises:

a plurality of blades oriented with respect to an axis about which said impeller rotates to provide axial flow of said fluids, said blades having leading and trailing edges and width between said edges and being pitched to produce said axial flow, at least one of said blades having a Venturi rotatable therewith and defining a flow path between said leading and trailing edges, said flow path having a width which converges in a direction from said leading to said trailing edge in which said second fluid is sheared and from which said second fluid is dispersed into said first fluid during mixing of said fluid by said impeller;

wherein a funnel structure defines said Venturi, said funnel structure having a larger opening and a smaller opening and converging between said openings in a direction from said leading to said trailing edges, said larger and smaller openings being in a size ratio which is in the range from substantially two to one to four to one.

2. The impeller according to claim 1, wherein said Venturi is defined by a funnel structure which has a generally rectangular opening the width of which converges in a direction from said leading edge to said trailing edge.

3. A mixing impeller which provides for dispersion of a first fluid differing from a second fluid when said fluids are mixed by said impeller, which impeller comprises a plurality of blades oriented with respect to an axis about which said impeller rotates to provide axial flow of said fluids, said blades having leading and trailing edges, at least one of said blades having a Venturi rotatable therewith and defining a flow path between said leading and trailing edges, said flow path having a width which converges in a direction from said leading edge to said trailing edge in which said second fluid is sheared and from which said second fluid is dispersed into said first fluid during mixing of said fluids by said impeller, and wherein said Venturi is defined by a funnel structure which has a generally rectangular opening the width of which converges in a direction from said leading edge to said trailing edge, and wherein said width is about 1% of the diameter of said impeller at an end of said structure closest to the trailing edge and about 4% of said diameter at an end of said structure closest to the leading edge.

4. A mixing impeller which provides for dispersion of a first fluid differing from a second fluid when said fluids are mixed by said impeller, which impeller comprises:

a plurality of blades oriented with respect to an axis about which said impeller rotates to provide axial flow of said fluids, said blades having leading and trailing edges, at least one of said blades having a Venturi rotatable therewith and defining a flow path between said leading and trailing edges, said flow path having a width which converges in a direction from said leading edge to said trailing edge in which said second fluid is sheared and from which said second fluid is dispersed into said first fluid during mixing of said fluids by said impeller; and wherein said Venturi is provided by a wedge shaped structure having its larger end closer to said leading edge and its smaller end closer to said trailing edge; and wherein said wedge shaped structure has a neck intermediate the ends thereof and tapers inwardly toward said neck and outwardly away from said neck.

5. A mixing impeller which provides for dispersion of a first fluid differing from a second fluid when said fluids are mixed by said impeller, which impeller comprises a plurality of blades oriented with respect to an axis about which said impeller rotates to provide axial flow of said fluids, said blades having leading and trailing edges, at least one of said blades having a Venturi rotatable therewith and defining a flow path between said leading and trailing edges, said flow path having a width which converges in a direction from said leading edge to said trailing edge in which said second fluid is sheared and from which said second fluid is dispersed into said first fluid during mixing of said fluids by said impeller, and wherein said impeller blades have tips at end thereof disposed radially outward from said axis, at least one of said blades having a segment of the same curvature as and overlying one of the surfaces of said at least one blade which extends radially inward of said blade from said tip along said trailing edge, said segment being disposed at an angle with respect to said one surface of said blade so as to provide a wedge shaped opening increasing in size from an end of said segments spaced from said trailing edge of said blade, which provides an entrance of said flow path, to an end of said segment adjacent to said trailing edge, which provides an exit of said flow path.

6. The impeller according to claim 5 wherein said segment is part of another blade which is of generally the same shape as said at least one blade and is spaced from said one surface of said least one blade.

7. The impeller according to claim 6 wherein said one surface is the suction side of said blade.

8. The impeller according to claim 5 wherein said segment is one of a pair of segments which is disposed on the suction side of said blade while the other of said pair of segments is disposed on the pressure side of said blade so as to define a pair of Venturis.

9. The mixing impeller according to claim 5 wherein said least one blade along said trailing edge, or said segment along said trailing edge, has a serrated edge extending from said tip radially inward at least the extent of said segment along said trailing edge.

10. The impeller according to claim 9 wherein said serrated trailing edge is scalloped by being provided by a series of notches.

11. A mixing impeller which provides for dispersion of a first fluid differing from a second fluid when said fluids are mixed by said impeller, which impeller comprises a plurality of blades oriented with respect to an axis about which said impeller rotates to provide axial flow of said fluids, said blades having leading and trailing edges, at least one of said blades having a Venturi rotatable therewith and defining a flow path between said leading and trailing edges, said flow path having a width which converges in a direction from said leading edge to said trailing edge in which said second fluid is sheared and from which said second fluid is dispersed into said first fluid during mixing of said fluids by said impeller, and wherein said impeller blades have tips at ends radially outward from said axis, and said Venturi is defined by a pair of proplets or fins at least at one of said tips.

12. The impeller according to claim 11 wherein said proplets have leading and trailing edges, one of said proplets is at said tip and the other is spaced radially inward therefrom to define an entry to said flow path of generally rectangular shape at said leading edges of said proplets, and an exit from said flow path also of generally rectangular shape but smaller in width than said entry at or near the trailing edges of said proplets, said width being in a direction radially inward between said proplets.

13. The impeller according to claim 12 wherein one of said proplets which is radially further outward than the other has a length between said leading and trailing edges thereof at said tip which is longer than the length between of the other of said proplets between the leading and trailing edges thereof.

14. The impeller according to claim 12 wherein said proplets extend above one side of said blades or below the other side of said blades or extend across said blades between said one side and said other side.

15. The impeller according to claim 12 wherein one of said proplets extends along said tip and is a generally flat plate while the other of said proplets tapers inwardly towards said one proplet.

16. The impeller according to claim 15 wherein said other of said proplets tapers inwardly to a neck which defines the smallest width of said flow passage and then tapers outwardly away from said one proplet.

17. The impeller system according to claim 15 wherein said proplet which extends along the tip extends forwardly beyond said leading edge of said blade and rearwardly beyond said trailing edge of said blade and said other proplet extends at least from said leading edge of said blade a distance equal to the extension of said one proplet rearwardly beyond said trailing edge of said blade.

18. The impeller according to claim 12 wherein one of said proplets extends along said tip and the other of said proplets is disposed radially outward from said one proplet and defines a wedge shaped, opening open on all sides thereof.

19. The impeller system according to claim 12 wherein the trailing edge of at least one of said pair of proplets has a series of serrations.

20. The impeller system according to claim 12 wherein said proplets have forward ends closest to said leading edges and taper inwardly in a direction towards said trailing edges, and said proplets have top edges thereof which are spaced from a surface of said impeller, away from which said proplet extends.

21. The impeller according to claim 12 wherein said proplets extend above a surface of said blades to upper edges which are covered at least over a portion of said upper edges.

22. The impeller according to claim 12 wherein said pair of proplets and said blade from which said proplets extends is a sheet of material, said sheet having folds therein which define a radially outward one of said proplets, and also a radially inward one of said proplets, and also a section about an outer edge of said proplets which forms a cover over at least a portion of the outer edges of said proplets over said flow path.

* * * * *